US008345902B2

(12) United States Patent
Ma et al.

(10) Patent No.: US 8,345,902 B2
(45) **Date of Patent: *Jan. 1, 2013**

(54) HEARING AID WITH MEANS FOR DECORRELATING INPUT AND OUTPUT SIGNALS

(75) Inventors: Guilin Ma, Lyngby (DK); Karl-Fredrik Johan Gran, Malmo (SE)

(73) Assignee: GN ReSound A/S, Ballerup (DK)

( * ) Notice: Subject to any disclaimer, the term of this patent is extended or adjusted under 35 U.S.C. 154(b) by 270 days.

This patent is subject to a terminal disclaimer.

(21) Appl. No.: 12/580,864

(22) Filed: Oct. 16, 2009

(65) Prior Publication Data

US 2011/0064252 A1 Mar. 17, 2011

(30) Foreign Application Priority Data

Sep. 14, 2009 (EP) ..... 09170200

(51) Int. Cl.
*H04R 25/00* (2006.01)

(52) U.S. Cl. ..... 381/318; 381/312; 381/320; 381/60

(58) Field of Classification Search ..... None
See application file for complete search history.

(56) References Cited

U.S. PATENT DOCUMENTS

| | | | | |
|---|---|---|---|---|
| 5,619,580 | A * | 4/1997 | Hansen | 381/314 |
| 5,680,467 | A | 10/1997 | Hansen | |
| 5,710,822 | A | 1/1998 | Steenhagen et al. | |
| 5,771,299 | A * | 6/1998 | Melanson | 381/316 |
| 6,347,148 | B1 | 2/2002 | Brennan | |
| 6,498,858 | B2 | 12/2002 | Kates | |
| 2004/0019492 | A1 * | 1/2004 | Tucker et al. | 704/500 |
| 2005/0086058 | A1 * | 4/2005 | Lemelson et al. | 704/270 |
| 2006/0291681 | A1 * | 12/2006 | Klinkby et al. | 381/318 |
| 2007/0269068 | A1 * | 11/2007 | Komagel et al. | 381/318 |
| 2009/0034768 | A1 | 2/2009 | Lunner | |

FOREIGN PATENT DOCUMENTS

| | | |
|---|---|---|
| EP | 1742509 | 1/2007 |
| EP | 1853089 | 11/2007 |
| WO | 2005081584 | 9/2005 |
| WO | 2007053896 | 5/2007 |

OTHER PUBLICATIONS

Spriet, A.; Proudler, I.; Moonen, M.; Wouters, J.; , "Adaptive feedback cancellation in hearing aids with linear prediction of the desired signal," Signal Processing, IEEE Transactions on , vol. 53, No. 10, pp. 3749-3763, Oct. 2005.*

(Continued)

*Primary Examiner* — Yuwen Pan
*Assistant Examiner* — Taunya McCarty
(74) *Attorney, Agent, or Firm* — Vista IP Law Group, LLP

(57) ABSTRACT

A hearing aid includes a microphone for converting sound into an audio input signal, a hearing loss processor configured for processing the audio input signal or a signal derived from the audio input signal in accordance with a hearing loss of a user of the hearing aid, a synthesizer configured for generation of a synthesized signal based at least on a sound model and the audio input signal, the synthesizer comprising a noise generator configured for excitation of the sound model for generation of the synthesized signal including synthesized vowels, and a receiver for generating an output sound signal based at least on the synthesized signal.

18 Claims, 7 Drawing Sheets

OTHER PUBLICATIONS

European Search Report dated Feb. 1, 2010 for EP App No. 09170200.1.

Kadaba: "Artificial Speech Synthesis Using LPC". May 8, 2007, Audio Engineering Society, 122nd Convention, Vienna, Austria, XP002563371, pp. 1-5.

European Search Report Dated Jan. 19, 2010 for EP Application No. 09170198.7.

Spriet, Ann et al., "Adaptive Feedback Cancellation in Hearing Aids with Linear Prediction of the Desired Signal", IEEE Transactions on Signal Processing, vol. 53, No. 10, pp. 3749-3763, Oct. 2005.

* cited by examiner

HEARING AID WITH MEANS FOR DECORRELATING INPUT AND OUTPUT SIGNALS

RELATED APPLICATION DATA

This application claims priority to and the benefit of European patent application No. 09170200.1, filed on Sep. 14, 2009.

This application is related to U.S. patent application Ser. No. 12/580,888, filed on Oct. 16, 2009.

FIELD

The application relates to a hearing aid, especially a hearing aid with means for de-correlating input and output signals and a hearing aid with means for feedback cancellation.

BACKGROUND

Feedback is a well known problem in hearing aids and several systems for suppression and cancellation of feedback exist within the art. With the development of very small digital signal processing (DSP) units, it has become possible to perform advanced algorithms for feedback suppression in a tiny device such as a hearing instrument, see e.g. U.S. Pat. No. 5,619,580, U.S. Pat. No. 5,680,467 and U.S. Pat. No. 6,498,858.

The above mentioned prior art systems for feedback cancellation in hearing aids are all primarily concerned with the problem of external feedback, i.e. transmission of sound between the loudspeaker (often denoted receiver) and the microphone of the hearing aid along a path outside the hearing aid device. This problem, which is also known as acoustical feedback, occurs e.g. when a hearing aid ear mould does not completely fit the wearer's ear, or in the case of an ear mould comprising a canal or opening for e.g. ventilation purposes. In both examples, sound may "leak" from the receiver to the microphone and thereby cause feedback.

However, feedback in a hearing aid may also occur internally as sound can be transmitted from the receiver to the microphone via a path inside the hearing aid housing. Such transmission may be airborne or caused by mechanical vibrations in the hearing aid housing or some of the components within the hearing instrument. In the latter case, vibrations in the receiver are transmitted to other parts of the hearing aid, e.g. via the receiver mounting(s).

WO 2005/081584 discloses a hearing aid capable of compensating for both internal mechanical and/or acoustical feedback within the hearing aid housing and external feedback.

It is well known to use an adaptive filter to estimate the feedback path. In the following, this approach is denoted adaptive feedback cancellation (AFC) or adaptive feedback suppression. However, AFC produce biased estimations of the feedback path in response to correlated input signals, such as music.

Several approaches have been proposed to reduce the bias. Classical approaches include introducing signal de-correlating operations in the forward path or the cancellation path, such as delays or non-linearities, adding a probe signal to the receiver input, and controlling the adaptation of the adaptation of the feedback canceller, e.g., by means of constrained or band limited adaptation. One of these known approaches for reducing the bias problem is disclosed in US 2009/0034768, wherein frequency shifting is used in order to de-correlate the input signal from the microphone from the output signal at the receiver in a certain frequency region.

SUMMARY

In the following, a new approach for de-correlating the input signal from the microphone and the output signal at the receiver and thereby reducing the bias problem in a hearing aid is provided.

Thus, a hearing aid is provided comprising:

a microphone for converting sound into an audio input signal, a hearing loss processor configured for processing the audio input signal in accordance with the hearing loss of the user of the hearing aid, a receiver for converting an audio output signal into an output sound signal, a synthesizer configured for generation of a synthesized signal based on a sound model and the audio input signal and for including the synthesized signal in the audio output signal, the synthesizer further comprising a noise generator configured for excitation of the sound model for generation of the synthesized signal including synthesized vowels.

In prior art linear prediction vocoders, the sound model is excited with a pulse train in order to synthesize vowels. Utilizing a noise generator for synthesizing both voiced and un-voiced speech simplifies the hearing aid circuitry in that the requirement of voiced activity detection together with pitch estimation are eliminated, and thus the computational load of the hearing aid circuitry is kept at a minimum. Furthermore, the synthesized signal is generated in such a way that it is not correlated with the input signal so that inclusion of the synthesized signal in the audio output signal of the hearing aid reduces the bias problem as well. Hence, a hearing aid is provided wherein the input signal from the microphone is de-correlated from the output signal at the receiver, in a computationally much simpler way than is known from any of the known prior art systems.

The synthesized signal may be included before or after processing of the audio input signal in accordance with the hearing loss of the user.

The sound model is in an embodiment a signal model of the audio stream.

The noise generator is preferably a white noise generator. A great advantage of using white noise is that a very efficient decorrelation of the incoming and output signals is achieved. However, in another embodiment it may be a random or pseudo-random noise generator or a noise generator generating noise with some degree of colouring, e.g. brown or pink noise.

An input of the synthesizer may be connected at the input side of the hearing loss processor, and/or an output of the synthesizer may be connected at the input side of the hearing loss processor.

An input of the synthesizer may be connected at the output side of the hearing loss processor and/or an output of the synthesizer may be connected at the output side of the hearing loss processor.

The synthesized signal may be included in the audio signal anywhere in the circuitry of the hearing aid, for example by attenuating the audio signal at a specific point in the circuitry of the hearing aid and in a specific frequency band and adding the synthesized signal to the attenuated or removed audio signal in the specific frequency band for example in such a way that the amplitude or loudness and power spectrum of the resulting signal remains substantially equal or similar to the original un-attenuated audio signal. Thus, the hearing aid may comprise a filter with an input for the audio signal, for example connected to one of the input and the output of the hearing loss processor, the filter attenuating the input signal to the filter in the specific frequency band. The filter further has an output supplying the attenuated signal in combination with the synthesized signal. The filter may for example incorporate an adder.

The frequency band may be adjustable.

In a similar way, instead of being attenuated, the audio signal may be substituted with the synthesized signal at a specific point in the circuitry of the hearing aid and in a specific frequency band. Thus, the filter may be configured for removing the filter input signal in the specific frequency band and adding the synthesized signal instead, for example in such a way that the amplitude or loudness and power spectrum of the resulting signal remains substantially equal or similar to the original audio signal input to the filter.

For example, feedback oscillation may take place above a certain frequency only or mostly, such as above 2 kHz, so that bias reduction is only required above this frequency, e.g. 2 kHz. Thus, the low frequency part; e.g. below 2 kHz, of the original audio signal may be maintained without any modification, while the high frequency part, e.g. above 2 kHz, may be substituted completely or partly by the synthesized signal, preferably in such a way that the amplitude or loudness and power spectrum of the resulting signal remains substantially unchanged as compared to the original non-substituted audio signal The sound model may be based on linear prediction analysis. Thus, the synthesizer may be configured for performing linear prediction analysis. The synthesizer may further be configured for performing linear prediction coding.

Linear prediction analysis and coding lead to improved feedback compensation in the hearing aid in that larger gain is made possible and dynamic performance is improved without sacrificing speech intelligibility and sound quality especially for hearing impaired people.

The hearing aid may, according to an embodiment, further comprise an adaptive feedback suppressor configured for generation of a feedback suppression signal by modelling a feedback signal path of the hearing aid, having an output that is connected to a subtractor connected for subtracting the feedback suppression signal from the audio input signal and output a feedback compensated audio signal to an input of the hearing loss processor.

The feedback compensator may further comprise a first model filter for modifying the error input to the feedback compensator based on the sound model.

The feedback compensator may further comprise a second model filter for modifying the signal input to the feedback compensator based on the sound model. Hereby is achieved that the sound model (also denoted signal model) is removed from the input signal and the output signal so that only white noise goes into the adaptation loop, which ensures a faster convergence, especially if a LMS (Least Means Squares)-type adaptation algorithm is used to update the feedback compensator.

In accordance with some embodiments, a hearing aid includes a microphone for converting sound into an audio input signal, a hearing loss processor configured for processing the audio input signal or a signal derived from the audio input signal in accordance with a hearing loss of a user of the hearing aid, a synthesizer configured for generation of a synthesized signal based at least on a sound model and the audio input signal, the synthesizer comprising a noise generator configured for excitation of the sound model for generation of the synthesized signal including synthesized vowels, and a receiver for generating an output sound signal based at least on the synthesized signal.

Other and further aspects and features will be evident from reading the following detailed description of the embodiments, which are intended to illustrate some of the embodiments, and not limit the invention.

BRIEF DESCRIPTION OF THE DRAWINGS

In the following, preferred embodiments are explained in more detail with reference to the drawing, wherein.

DESCRIPTION OF THE EMBODIMENTS

Figure 1:
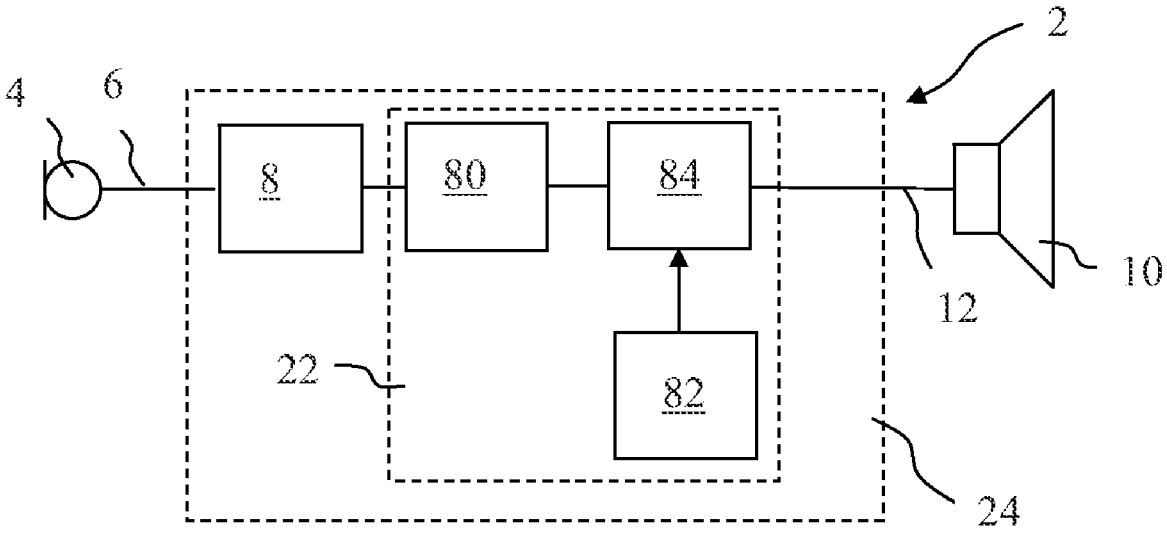
FIG. 1 shows an embodiment of a hearing aid.

The present application will now be described more fully hereinafter with reference to the accompanying drawings, in which exemplary embodiments are shown. The claimed invention may, however, be embodied in different forms and should not be construed as limited to the embodiments set forth herein. Like reference numerals refer to like elements throughout. Like elements will, thus, not be described in detail with respect to the description of each figure. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 shows an embodiment of a hearing aid 2. The illustrated hearing aid 2 comprises: a microphone 4 for converting sound into an audio input signal 6, a hearing loss processor 8 configured for processing the audio input signal 6 in accordance with a hearing loss of a user of the hearing aid 2, a receiver 10 for converting an audio output signal 12 into an output sound signal. The illustrated hearing aid also comprises a synthesizer 22 configured for generation of a synthesized signal based on a sound model and the audio input signal and for including the synthesized signal in the audio output signal 12. The illustrated synthesizer 22 comprises a noise generator 82 configured for excitation of the sound model for generation of the synthesized signal including synthesized vowels. The modelling of the input signal is illustrated by the coding block 80, which provides a signal model. This signal model is excited by the noise signal from the noise generator 82 in the coding synthesizing block 84, whereby is achieved that the output of the synthesizer 22 is a synthesized signal that is uncorrelated with the input signal 6. The sound model may be an AR model (Auto-regressive model).

In a preferred embodiment, the processing performed by the hearing loss processor 8 is frequency dependent and the synthesizer 22 performs a frequency dependent operation as well. This could for example be achieved by only synthesizing the high frequency part of the output signal from the hearing loss processor 8.

According to an alternative embodiment of a hearing aid 2, the placement of the hearing loss processor 8 and the synthesizer 22 may be interchanged so that the synthesizer 22 is placed before the hearing loss processor 8 along the signal path from the microphone 4 to the receiver 10.

According to a preferred embodiment of a hearing aid 2 the hearing loss processor 8, synthesizer 22 (including the units 80, 82 and 84), forms part of a hearing aid digital signal processor (DSP) 24.

Figure 2:
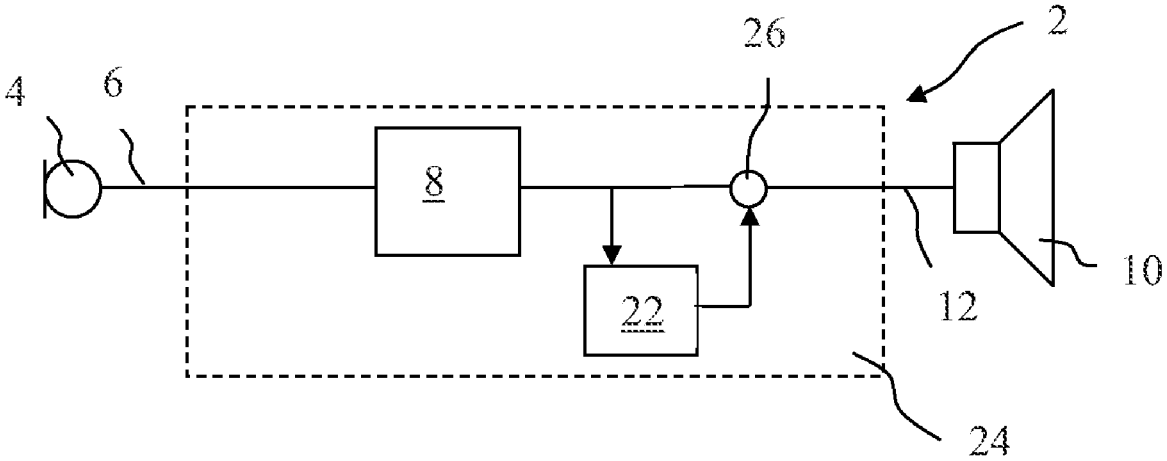
FIG. 2 shows an embodiment of a hearing aid.

FIG. 2 shows an alternative embodiment of a hearing aid 2, wherein the input of the synthesizer 22 is connected at the output side of the hearing loss processor 8 and the output of the synthesizer 22 is connected at the output side of the hearing loss processor 8, via the adder 26 that adds the synthesized signal generated by the synthesizer 22 to the output of the hearing loss processor 8.

Figure 3:
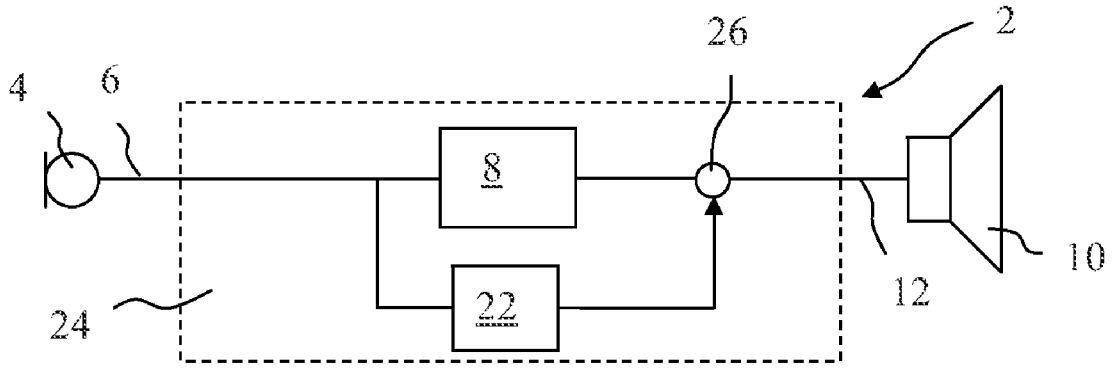
FIG. 3 shows an embodiment of a hearing aid.

FIG. 3 shows a further alternative embodiment of a hearing aid 2, wherein an input to the synthesizer 22 is connected at the input side of the hearing loss processor 8, and the output of the synthesizer 22 is connected at the output side of the hearing loss processor 8, via the adder 26 that adds the output signal of the synthesizer 22 to the output of the hearing loss processor 8.

The embodiments shown in FIG. 2 and FIG. 3 are very similar to the embodiment shown in FIG. 1. Hence, only the differences between these have been described.

Figure 4:
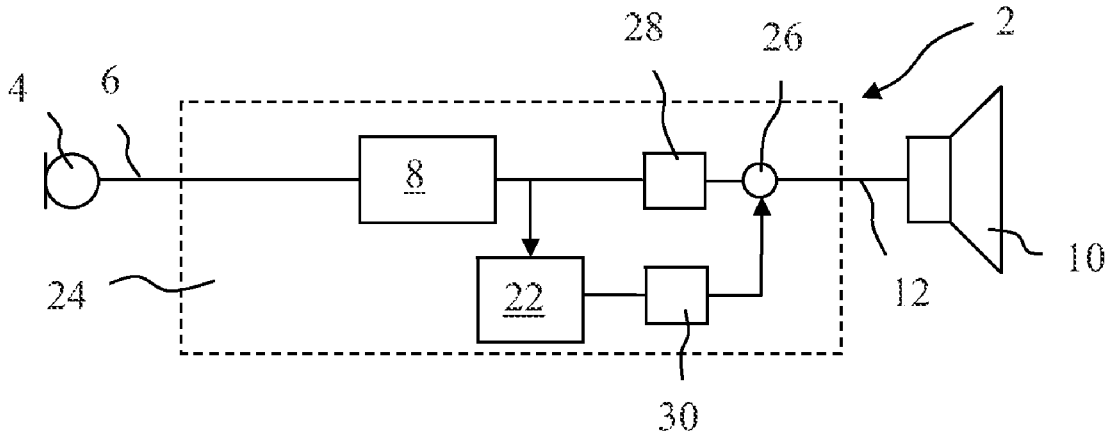
FIG. 4 shows an embodiment of a hearing aid.
Figure 5:
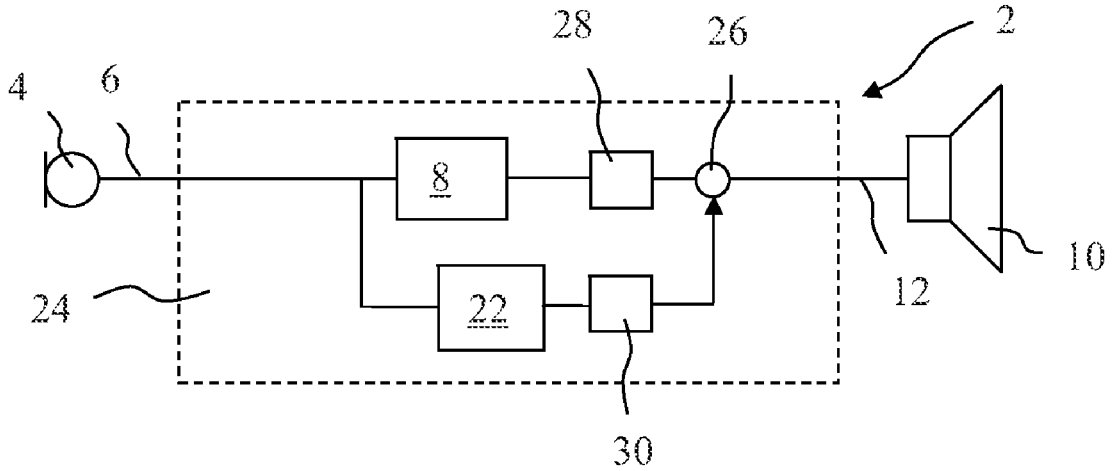
FIG. 5 shows an embodiment of a hearing aid.

Previous research on patients suffering from high frequency hearing loss has shown that feedback is generally most common at frequencies above 2 kHz. This suggests that the reduction of the bias problem in most cases will only be necessary in the frequency region above 2 kHz in order to improve the performance of the adaptive feedback suppression. Therefore, in order to decorrelate the input and output signals 6 and 12, the synthesized signal is only needed in the high frequency region while the low frequency part of the signal can be maintained without modification. Hence, two alternative embodiments to those shown in FIG. 2 and FIG. 3 may be envisioned, wherein a low pass filter 28 is inserted in the signal path between the output of the hearing loss processor 8 and the adder 26, and a high pass filter 30 is inserted in the signal path between the output of the synthesizer 22 and the adder 26. This situation is illustrated in the embodiments shown in FIG. 4 and FIG. 5. Alternatively, the filter 28 may be one that only to a certain extent dampens the high frequency part of the output signal of the hearing loss processor 8. Similarly, in an alternative embodiment the filter 30 may be one that only to a certain extent dampens the low frequency part of the synthesized output signal from the synthesizer 22. The filter 30 can also be moved into the synthesizer 22 (two ways: between 82 and 84; or in to 80, so that the modelling is only in the high frequencies).

The crossover or cutoff frequency of the filters 28 and 30 may in one embodiment be set at a default value, for example in the range from 1.5 kHz-5 kHz, preferably somewhere between 1.5 and 4 kHz, e.g. any of the values 1.5 kHz, 1.6 kHz, 1.8 kHz, 2 kHz, 2.5 kHz, 3 kHz, 3.5 kHz or 4 kHz. However, in an alternative embodiment, the crossover or cutoff frequency of the filters 28 and 30, may be chosen to be somewhere in the range from 5 kHz-20 kHz.

Alternatively, the cutoff or crossover frequency of the filters 28 and 30 may be chosen or decided upon in a fitting situation during fitting of the hearing aid 2 to a user, and based on a measurement of the feedback path during fitting of the hearing aid 2 to a particular user. The cutoff or crossover frequency of the filters 28 and 30 may also be chosen in dependence of a measurement or estimation of the hearing loss of a user of the hearing aid 2. The cutoff or crossover frequency of the filters 28 and 30 may also be adjusted adaptively by checking if and where the feedback whistling is about to build up. In yet an alternative embodiment, the crossover or cutoff frequency of the filters 28 and 30 may be adjustable.

Alternatively from using low and high pass filters 28 and 30, the output signal from the hearing loss processor 8 may be replaced by a synthesized signal from the synthesizer 22 in selected frequency bands, wherein the hearing aid 2 is most sensitive to feedback. This could for example be implemented by using a suitable arrangement of a filterbank.

Figure 6:
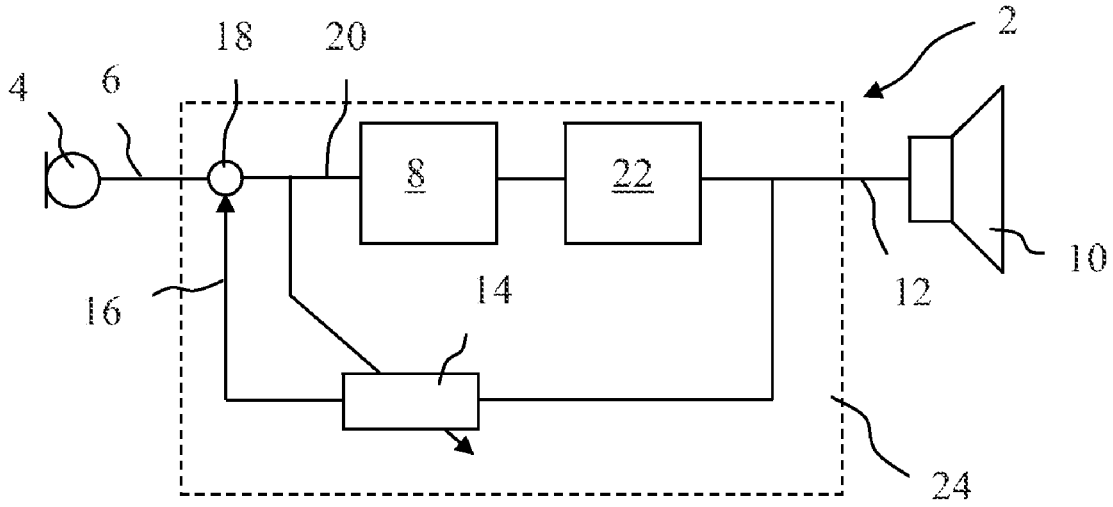
FIG. 6 shows an embodiment of a hearing aid.

FIG. 6 shows an embodiment of a hearing aid 2. The illustrated hearing aid 2 comprises: A microphone 4 for converting sound into an audio input signal 6, a hearing loss processor 8 configured for processing the audio input signal 8 in accordance with a hearing loss of a user of the hearing aid 2, a receiver 10 for converting an audio output signal 12 into an output sound signal. The illustrated hearing aid 2 also comprises an adaptive feedback suppressor 14 configured for generation of a feedback suppression signal 16 by modeling a feedback signal path (not illustrated) of the hearing aid 2, wherein the adaptive feedback suppressor 14 has an output that is connected to a subtractor 18 connected for subtracting the feedback suppression signal 16 from the audio input signal 6, the subtractor 18 consequently outputting a feedback compensated audio signal 20 to an input of the hearing loss processor 8. The hearing aid 2 also comprises a synthesizer 22 configured for generation of a synthesized signal based on a sound model and the audio input signal, and for including the synthesized signal in the audio output signal 12. The sound model may be an AR model (Auto-regressive model).

In a preferred embodiment, the processing performed by the hearing loss processor 8 is frequency dependent and the synthesizer 22 performs a frequency dependent operation as well. This could for example be achieved by only synthesizing the high frequency part of the output signal from the hearing loss processor 8.

According to an alternative embodiment of a hearing aid 2, the placement of the hearing loss processor 8 and the synthesizer 22 may be interchanged so that the synthesizer 22 is placed before the hearing loss processor 8 along the signal path from the microphone 4 to the receiver 10.

According to a preferred embodiment of a hearing aid 2 the hearing loss processor 8, synthesizer 22, adaptive feedback suppressor 14 and subtractor 18 forms part of a hearing aid digital signal processor (DSP) 24.

Figure 7:
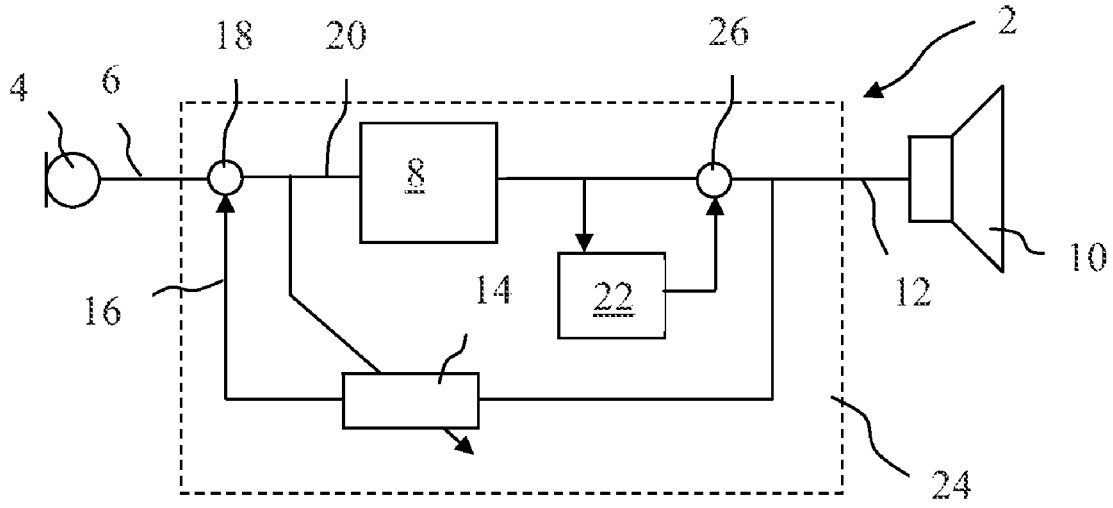
FIG. 7 shows an embodiment of a hearing aid.

FIG. 7 shows an alternative embodiment of a hearing aid 2, wherein the input of the synthesizer 22 is connected at the output side of the hearing loss processor 8 and the output of the synthesizer 22 is connected at the output side of the hearing loss processor 8, via the adder 26 that adds the synthesized signal generated by the synthesizer 22 to the output of the hearing loss processor 8.

Figure 8:
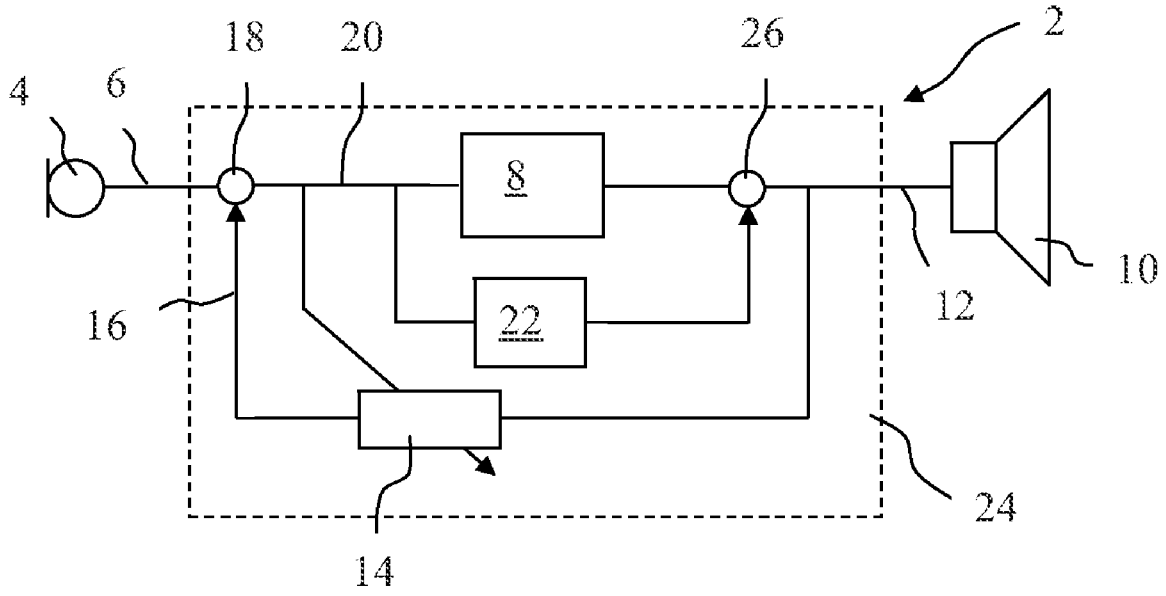
FIG. 8 shows an embodiment of a hearing aid.

FIG. 8 shows a further alternative embodiment of a hearing aid 2, wherein an input to the synthesizer 22 is connected at the input side of the hearing loss processor 8, and the output of the synthesizer 22 is connected at the output side of the hearing loss processor 8, via the adder 26 that adds the output signal of the synthesizer 22 to the output of the hearing loss processor 8.

The embodiments shown in FIG. 7 and FIG. 8 are very similar to the embodiment shown in FIG. 6. Hence, only the differences between these have been described.

Figure 9:
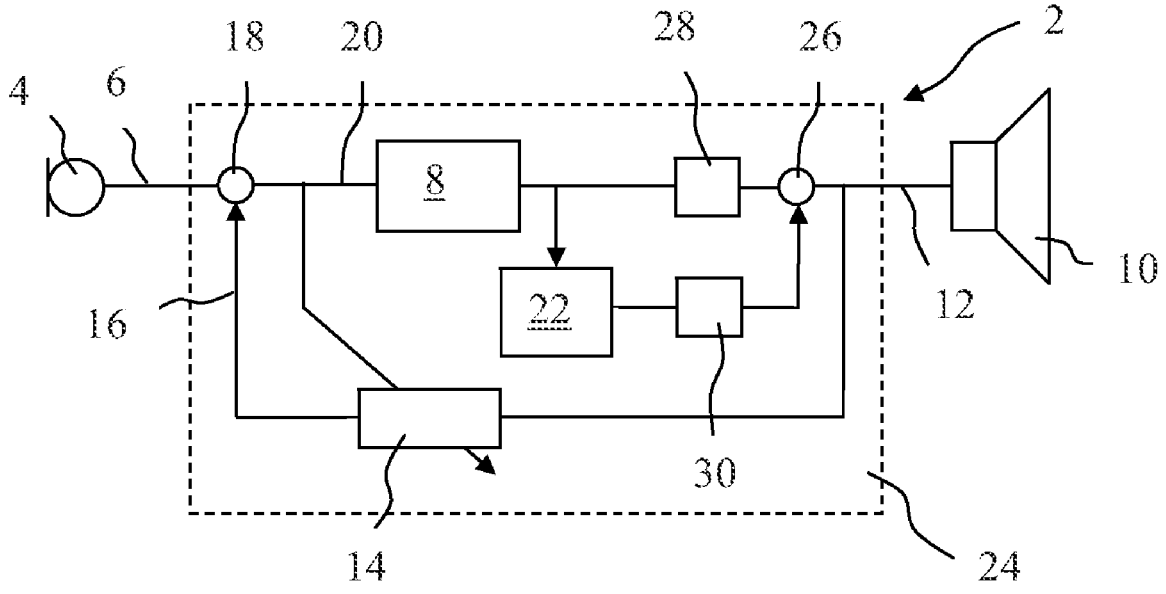
FIG. 9 shows an embodiment of a hearing aid.
Figure 10:
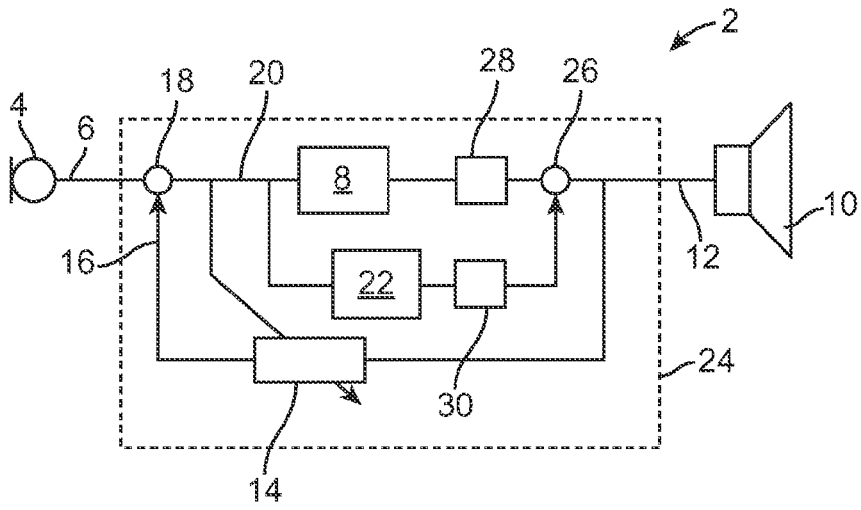
FIG. 10 shows an embodiment of a hearing aid.

Previous research on patients suffering from high frequency hearing loss has shown that feedback is generally most common at frequencies above 2 kHz. This suggests that the reduction of the bias problem in most cases will only be necessary in the frequency region above 2 kHz in order to improve the performance of the adaptive feedback suppression. Therefore, in order to decorrelate the input and output signals 6 and 12, the synthesized signal is only needed in the high frequency region while the low frequency part of the signal can be maintained without modification. Hence, two alternative embodiments to those shown in FIG. 7 and FIG. 8 may be envisioned, wherein a low pass filter 28 is inserted in the signal path between the output of the hearing loss processor 8 and the adder 26, and a high pass filter 30 is inserted in the signal path between the output of the synthesizer 22 and the adder 26. This situation is illustrated in the embodiments shown in FIG. 9 and FIG. 10. Alternatively, the filter 28 may be one that only to a certain extent dampens the high frequency part of the output signal of the hearing loss processor 8. Similarly, in an alternative embodiment the filter 30 may be one that only to a certain extent dampens the low frequency part of the synthesized output signal from the synthesizer 22. The filter 30 can also be moved into the synthesizer 22 (two ways: between 82 and 84; or into 80, so that the modelling is only performed in the high frequencies).

The crossover or cutoff frequency of the filters 28 and 30 may in one embodiment be set at a default value, for example in the range from 1.5 kHz-5 kHz, preferably somewhere between 1.5 and 4 kHz, e.g. any of the values 1.5 kHz, 1.6 kHz, 1.8 kHz, 2 kHz, 2.5 kHz, 3 kHz, 3.5 kHz or 4 kHz. However, in an alternative embodiment, the crossover or cutoff frequency of the filters 28 and 30, may be chosen to be somewhere in the range from 5 kHz-20 kHz.

Alternatively, the cutoff or crossover frequency of the filters 28 and 30 may be chosen or decided upon in a fitting situation during fitting of the hearing aid 2 to a user, and based on a measurement of the feedback path during fitting of the hearing aid 2 to a particular user. The cutoff or crossover frequency of the filters 28 and 30 may also be chosen in dependence of a measurement or estimation of the hearing loss of a user of the hearing aid 2. The cutoff or crossover frequency of the filters 28 and 30 may also be adjusted adaptively by checking if and where the feedback whistling is about to build up. In yet an alternative embodiment, the crossover or cutoff frequency of the filters 28 and 30 may be adjustable.

Alternatively from using low and high pass filters 28 and 30, the output signal from the hearing loss processor 8 may be replaced by a synthesized signal from the synthesizer 22 in selected frequency bands, wherein the hearing aid 2 is most sensitive to feedback. This could for example be implemented by using a suitable arrangement of a filterbank.

In the following detailed description of the preferred embodiments the description will be based on using Linear Predictive Coding (LPC) to estimate the signal model and synthesize the output sound. The LPC technology is based on Auto Regressive (AR) modeling which in fact models the generation of speech signals very accurately. The proposed algorithm according to a preferred embodiment can be broken down into four parts, 1) LPC analyzer: this stage estimates a parametric model of the signal, 2) LPC synthesizer: here the synthetic signal is generated by filtering white noise with the derived model, 3) a mixer which combines the original signal and the synthetic replica and 4) an adaptive feedback suppressor 14 which uses the output signal (original+synthetic) to estimate the feedback path (however, it is understood that alternatively the input signal could be split into bands and then run the LPC analyzer on one or more of the bands). The proposed solution basically includes of two parts—signal synthesis and feedback path adaptation. Below the signal synthesis will first be described, then a preferred embodiment of a hearing aid 2 will be described, wherein the feedback path adaptation scheme utilizes an external signal model and then an alternative embodiment of a hearing aid 2 will be described, wherein the adaptation is based on the internal LPC signal model (sound model).

Figure 11:
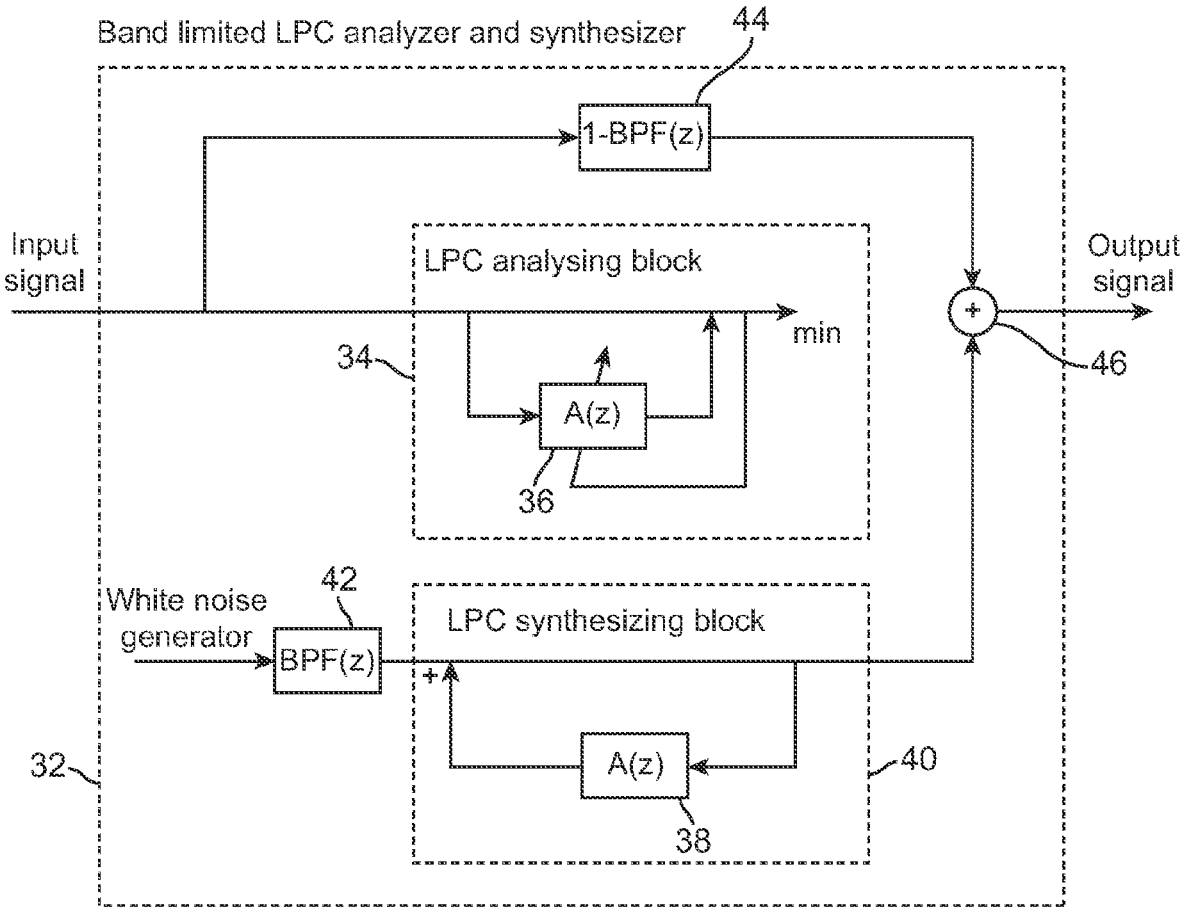
FIG. 11 is shown a so called Band limited LPC analyzer and synthesizer.

In FIG. 11 is shown a so called Band limited LPC analyzer and synthesizer (BLPCAS) 32. The illustrated BLPCAS 32 is a preferred way in which the synthesizer 22 may be embodied, wherein bandpass filters are incorporated. This configuration alleviates the need of the auxiliary filters 28 and 30 shown in FIG. 4, FIG. 5, FIG. 9 and FIG. 10.

Linear predictive coding is based on modeling the signal of interest as an all pole signal. An all pole signal is generated by the following difference equation $$x(n) = \sum_{l=1}^{L} a_l x(n-l) + e(n), \qquad \text{(eqn. 1)}$$

where x(n) is the signal, $\{a_l\}_{l=0}^{L-1}$ are the model parameters and e(n) is the excitation signal. If the excitation signal is white, Gaussian distributed noise, the signal is called and Auto Regressive (AR) process. The BLPCAS 32 shown in FIG. 11 comprises a white noise generator (not shown), or receives a white noise signal from an external white noise generator. If an all pole model of a measured signal y(n) is to estimated (in the mean squares sense) then the following optimization problem is formulated $$\hat{a} = \underset{a}{\operatorname{argmin}} E\left[\|y(n) - a^T y(n-1)\|^2\right] \qquad \text{(eqn. 2)}$$

where $a^T=(a_1\ a_2 \ldots a_L)$, and $y^T(n)=(y(n)\,y(n-1)\ldots y(n-L+1))$. If the signal indeed is a true AR process, the residual $y(n)-a^T y(n-1)$ will be perfect white noise. If it is not, the residual will be colored. This analysis and coding is illustrated by the LPC analysis block 34. The LPC analysis block 34 receives an input signal, which is analyzed by the model filter 36, which is adapted in such a way as to minimize the difference between the input signal to the LPC analysis block 34 and the output of the filter 36. When this difference is minimized the model filter 36 quite accurately models the input signal. The coefficients of the model filter 36 are copied to the model filter 38 in the LPC synthesizing block 40. The output of the model filter 38 is then excited by the white noise signal.

For speech, an AR model can be assumed with good precision for unvoiced speech. For voiced speech (A, E, O, etc.), the all pole model can still be used, but traditionally the excitation sequence has in this case been replaced by a pulse train to reflect the tonal nature of the audio waveform. According to an embodiment, only a white noise sequence is used to excitation the model. Here it is understood that speech sounds produced during phonation are called voiced. Almost all of the vowel sounds of the major languages and some of the consonants are voiced. In the English language, voiced consonants may be illustrated by the initial and final sounds in for example the following words: "bathe," "dog," "man," "jail". The speech sounds produced when the vocal folds are apart and are not vibrating are called unvoiced. Examples of unvoiced speech are the consonants in the words "hat," "cap," "sash," "faith". During whispering all the sounds are unvoiced.

When an all pole model has been estimated using equation (eqn. 2), the signal must be synthesized in the LPC synthesizing block 40. For unvoiced speech, the residual signal will be approximately white, and can readily be replaced by another white noise sequence, statistically uncorrelated with the original signal. For voiced speech or for tonal input, the residual will not be white noise, and the synthesis would have to be based on e.g. a pulse train excitation. However, a pulse train would be highly auto-correlated for a long period of time, and the objective of de-correlating the output at the receiver 10 and the input at the microphone 4 would be lost. Instead, the signal is also at this point synthesized using white noise even though the residual displays high degree of coloration. From a speech intelligibility point of view, this is fine, since much of the speech information is carried in the amplitude spectrum of the signal. However, from an audio quality perspective, the all pole model excited only with white noise will sound very stochastic and unpleasant. To limit the impact on quality, a specific frequency region is identified where the device is most sensitive to feedback (normally between 2-4 kHz). Consequently, the signal is synthesized only in this band and remains unaffected in all other frequencies. In FIG. 11, a block diagram of the band limited LPC analyzer 34 and synthesizer 40 can be seen. The LPC analysis is carried out for the entire signal, creating a reliable model for the amplitude spectrum. The derived coefficients are copied to the synthesizing block 40 (in fact to the model filter 38) which is driven by white noise filtered though a band limiting filter 42 designed to correspond to the frequencies where the synthesized signal is supposed to replace the original. A parallel branch filters the original signal with the complementary filter 44 to the band pass filter 42 used to drive the synthesizing block 40. Finally, the two signals are mixed in the adder 46 in order to generate a synthesized output signal. An alternative way is to move the band pass filter 42 to the point right before the band limited LPC analyzer 34. In this way, the model is only estimated with the signal in the frequency region of interest and white noise can be used to drive the model directly. The AR model estimation can be done in many ways. It is, however, important to keep in mind that since the model is to be used for synthesis and not only analysis, it is required that a stable and well behaved estimate is derived. One way of estimating a stable model is to use the Levinson Durbin recursion algorithm.

Figure 12:
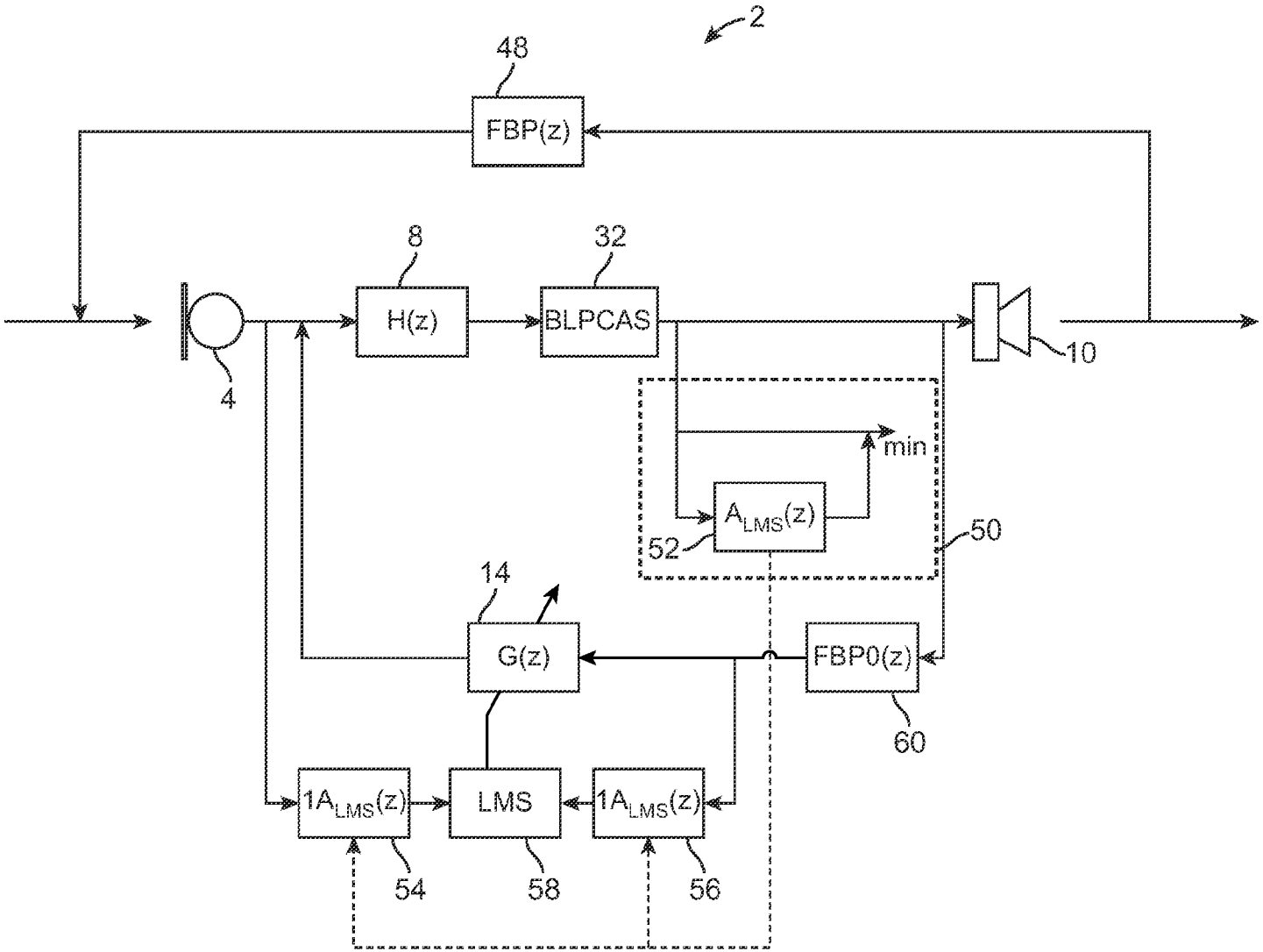
FIG. 12 illustrates a preferred embodiment of a hearing aid.

In FIG. 12 is showed a block diagram of a preferred embodiment of a hearing aid 2, wherein BLPCAS 32 is placed in the signal path from the output of the hearing loss processor 8 to the receiver 10. The present embodiment can be viewed as an add-on to an existing adaptive feedback suppression framework. Also illustrated is the undesired feedback path, symbolically shown as the block 48. The measured signal at the microphone 4 includes the direct signal and the feedback signal $$r(n)=s(n)+f(n),$$

$$f(n)=\mathrm{FBP}(z)y(n) \qquad \text{(eqn. 3)}$$

where r(n) is the microphone signal, s(n) is the incoming sound, f(n) is the feedback signal which is generated by filtering the output of the BLPCAS 32, y(n), with the impulse response of the feedback path. The output of the BLPCAS 32 can be written as $$y(n) = [1 - BPF(z)]y_0(n) + \underbrace{BPF(z)\left[\frac{1}{1 - A(z)}\right]w(n)}_{synthetic\ signal} \qquad \text{(eqn. 4)}$$

where w(n) is the synthesizing white noise process, A(z) are the model parameters of the estimated AR process, $y_0(n)$ is the original signal from the hearing loss processing block 8 and BPF(z) is a band-pass filter 42 selecting in which frequencies the input signal is going to be'replaced by a synthetic version.

The measured signal on the microphone will then be $$r(n) = s(n) + FBP(z)[1 - BPF(z)]y_0(n) + FBP(z)BPF(z)\left[\frac{1}{1 - A(z)}\right]w(n). \qquad \text{(eqn. 5)}$$

Before the output signal is sent to the receiver 10 (and to the adaptation loop), an AR model is computed of the composite signal. This is illustrated by the block 50. The AR model filter 52 has the coefficients $A_{LMS}(z)$ that are transferred to the filters 54 and 56 in the adaptation loop (these filters are preferably embodied as finite impulse response (FIR) filters or infinite impulse response (IIR) filters) and are used to de-correlate the receiver output signal and the incoming sound on the microphone 4. The filtered component going into the LMS updating block 58 from the microphone 4 (left in FIG. 12) is $$\begin{aligned} d_{LMS}(n) &= [1 - A_{LMS}(z)]r(n) \qquad \text{(eqn. 6)} \\ &= [1 - A_{LMS}(z)]s(n) + [1 - A_{LMS}(z)] \\ &\quad FBP(z)[1 - BPF(z)]y_0(n) + \ldots + \\ &\quad FBP(z)BPF(z)\left[\frac{1 - A_{LMS}(z)}{1 - A(z)}\right]w(n), \end{aligned}$$

And the filtered component to the LMS updating block 58 from the receiver side (right in FIG. 12) is $$\begin{aligned} u_{LMS}(n) &= [1 - A_{LMS}(z)]FBP0(z)y(n) \qquad \text{(eqn. 7)} \\ &= [1 - A_{LMS}(z)]FBP0(z)[1 - BPF(z)]y_0(n) + \\ &\quad \ldots + FBP0(z)BPF(z) \\ &\quad \left[\frac{1 - A_{LMS}(z)}{1 - A(z)}\right]w(n), \end{aligned}$$

where FRP0(n), indicated by the block 60, is the initial feedback path estimate derived at the fitting of the hearing aid 2 and should approximate the static feedback path as good as possible. The normalized LMS adaptation rule to minimize the effect of feedback will then be $$u_{LMS}(n) = (u_{LMS}(n)\, u_{LMS}(n-1)\ \ldots\ u_{LMS}(n-N+1))^T \qquad \text{(eqn. 8)}$$

$$e_{LMS}(n) = d_{LMS}(n) - g_{LMS}^T(n) u_{LMS}(n)$$

$$g_{LMS}(n+1) = g_{LMS}(n) + \mu \frac{u_{LMS}(n)}{\|u_{LMS}(n)\|} e_{LMS}(n)$$

where $g_{LMS}$ is the N tap FIR filter estimate of the residual feedback path after the initial estimate has been removed and μ is the adaptation constant governing the adaptation speed and steady state mismatch. It should be noted that the if the model parameters in the external LPC analysis block $A_{LMS}(z)$ match the ones given by the BLPCAS block 32, A(z), then the only thing remaining in the frequencies where signal substitution is carried out, is white noise. This will be very beneficial for the adaptation as the LMS algorithm has very fast convergence for white noise input. It can therefore be expected that the dynamic performance in the substituted frequency bands will be very much improved as compared to traditional adaptive filtered-X de-correlation. However, since the signal model used for de-correlation is derived using a LMS based adaptation scheme and the signal model in the BLPCAS 32 is based on other algorithms, such as Levinson-Durbin, it should be expected that the models are not identical at all times, but simulations have shown that this does not pose any problem.

In the illustrated embodiment the block 50 is connected to the output of the BLPCAS 32. However, in an alternative embodiment the block 50 could also be placed before the hearing loss processor 8, i.e. the input to the block 50 could be connected to the input to the hearing loss processor 8.

Figure 13:
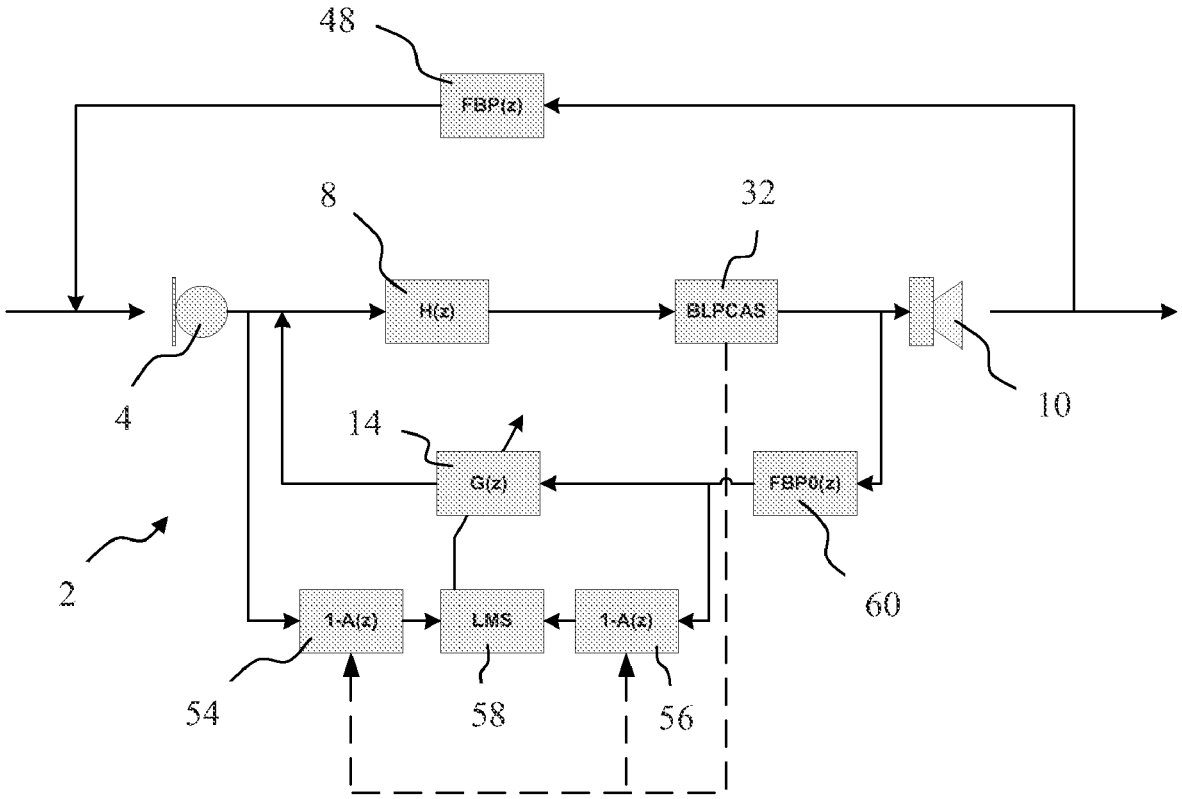
FIG. 13 illustrates an another preferred embodiment of a hearing aid.

FIG. 13 shows another preferred embodiment of a hearing aid 2, wherein the signal model from the BLPCAS 32 is used directly without an external modeler (illustrated as block 50 in the embodiment shown in FIG. 12). The output to the receiver 10 is the same as in eqn. 4 and the measured signal on the microphone 4 is identical to eqn. 5. The filtered component (filtered through the filter 54) going into the LMS feedback estimation block 58 from the microphone side is then $$d(n)=[1-A(z)]r(n)=[1-A(z)]s(n)+[1-A(z)]\mathrm{FBP}(z)[1-\mathrm{BPF}(z)]y_0(n)+\ldots+\mathrm{FBP}(z)\mathrm{BPF}(z)w(n), \qquad \text{(eqn. 9)}$$

Note that in this case, the only thing that remains after de-correlation in the frequency region where signal replacement takes place is the white excitation noise.

Correspondingly, the filtered component going into the LMS feedback estimation block 58 from the receiver side is $$u(n)=[1-A(z)]\mathrm{FBP0}(z)y(n)=[1-A(z)]\mathrm{FBP0}(z)[1-\mathrm{BPF}(z)]y_0(n)+\ldots+\mathrm{FBP0}(z)\mathrm{BPF}(z)w(n), \qquad \text{(eqn. 10)}$$

Now, the normalized LMS adaption rule will be $$u(n) = (u(n)\ u(n-1)\ \ldots\ u(n-N+1))^T \qquad \text{(eqn. 11)}$$

$$e(n) = d(n) - g^T(n) u(n)$$

$$g(n+1) = g(n) + \mu \frac{u(n)}{\|u(n)\|} e(n)$$

By keeping the low frequency part of the input signal and only perform the replacement by a synthetic signal in the high frequency region has the advantage that sound quality is significantly improved, while at the same time enabling a higher gain in the hearing aid 2, than in traditional hearing aids with feedback suppression systems.

Scientific investigations have shown that a hearing aid 2 according to any of the embodiments as described above with reference to the drawings, will enable a significant increase in the stable gain of the hearing aid, i.e. before whistling occurs. Increases in stable gain up to 10 dB has been measured, depending on the hearing aid and outer circumstances, as compared to existing prior art hearing aids with means for feedback suppression. In addition, the embodiments shown in FIG. 12 and FIG. 13 are very robust with respect to dynamical changes in the feedback path. This is due to the fact that since the model is subtracted from the signal in the filters 54 and 56, the LMS updating unit 58 adapts on a white noise signal (since a white noise signal is used to excite the sound model in the BLPCAS 32), which ensures optimal convergence of the LMS algorithm.

The crossover or cutoff frequency of the filters 42 and 44, illustrated in FIG. 11, may in one embodiment be set at a default value, for example in the range from 1.5 kHz-5 kHz, preferably somewhere between 1.5 and 4 kHz, e.g. any of the values 1.5 kHz, 1.6 kHz, 1.8 kHz, 2 kHz, 2.5 kHz, 3 kHz, 3.5 kHz or 4 kHz. However, in an alternative embodiment, the crossover or cutoff frequency of the filters 42 and 44, may be chosen to be somewhere in the range from 5 kHz-20 kHz.

Alternatively, the cutoff or crossover frequency of the filters 42 and 44 may be chosen or decided upon in a fitting situation during fitting of the hearing aid 2 to a user, and based on a measurement of the feedback path during fitting of the hearing aid 2 to a particular user. The cutoff or crossover frequency of the filters 42 and 44 may also be chosen in dependence of a measurement or estimation of the hearing loss of a user of the hearing aid 2. The cutoff or crossover frequency of the filters 42 and 44 may also be adjusted adaptively by checking if and where the feedback whistling is about to build up. In yet an alternative embodiment, the crossover or cutoff frequency of the filters 42 and 44 may be adjustable.

The invention claimed is:

1. A hearing aid comprising:

a microphone for converting sound into an audio input signal;

a hearing loss processor configured for processing the audio input signal or a signal derived from the audio input signal in accordance with a hearing loss of a user of the hearing aid;

a synthesizer configured for generation of a synthesized signal based at least on a sound model and the audio input signal, the synthesizer comprising a noise generator configured for excitation of the sound model for generation of the synthesized signal including synthesized vowels; and a receiver for generating an output sound signal based at least on the synthesized signal.

2. The hearing aid according to claim 1, wherein an input of the synthesizer is coupled to an input side of the hearing loss processor.

3. The hearing aid according to claim 2, wherein an output of the synthesizer is coupled to an output side of the hearing loss processor.

4. The hearing aid according to claim 1, wherein an output of the synthesizer is coupled to an input side of the hearing loss processor.

5. The hearing aid according to claim 1, wherein an input of the synthesizer is coupled to an output side of the hearing loss processor.

6. The hearing aid according to claim 1, further comprising a filter with a filter input coupled to an input or an output of the hearing loss processor and the synthesizer for attenuating a filter input signal in a frequency band, and a filter output for providing the attenuated filter signal.

7. The hearing aid according to claim 6, wherein the filter is configured for removing the filter input signal in the frequency band.

8. The hearing aid according to claim 6, wherein the frequency band is adjustable.

9. The hearing aid according to claim 1, wherein the synthesizer is configured for performing linear prediction analysis.

10. The hearing aid according to claim 9, wherein the synthesizer is further configured for performing linear prediction coding.

11. The hearing aid according to claim 1, wherein the signal derived from the input audio signal comprises a feedback compensated audio signal, and the hearing aid further comprises an adaptive feedback suppressor configured for generation of a feedback suppression signal by modelling a feedback signal path of the hearing aid, the adaptive feedback suppressor having an output that is connected to a subtractor for subtracting the feedback suppression signal from the audio input signal and outputting the feedback compensated audio signal to an input of the hearing loss processor.

12. The hearing aid according claim 11, wherein the feedback suppressor comprises a first model filter for modifying an error input to the feedback suppressor based on the sound model.

13. The hearing aid according to claim 12, wherein the feedback suppressor further comprises a second model filter for modifying the input signal to the feedback suppressor based at least on the sound model.

14. The hearing aid according to claim 1, wherein the sound model is based on linear prediction analysis.

15. The hearing aid according to claim 1, wherein the synthesizer is configured for performing linear prediction coding.

16. The hearing aid according to claim 1, wherein the sound model is an auto-regressive model.

17. The hearing aid according to claim 1, further comprising a combiner for providing a combined signal derived from the synthesized signal and an output from the hearing loss processor.

18. The hearing aid according to claim 17, further comprising:

a low pass filter between the hearing loss processor and the combiner; and a high pass filter between the synthesizer and the combiner.

* * * * *